United States Patent [19]

Tuttle

[11] 4,155,299

[45] May 22, 1979

[54] SCREEN FOR HYDRO-EXTRACTOR

[75] Inventor: Hiram A. Tuttle, Coventry, Conn.

[73] Assignee: Somat Corporation, Pomeroy, Pa.

[21] Appl. No.: 875,159

[22] Filed: Feb. 6, 1978

[51] Int. Cl.[2] ..... B30B 9/14

[52] U.S. Cl. ..... 100/117; 100/122

[58] Field of Search ..... 100/117, 122–124, 100/145–150; 210/314, 315, 497, 488, 492

[56] References Cited

U.S. PATENT DOCUMENTS

| | | | |
|---|---|---|---|
| 2,004,408 | 6/1935 | Hiller | 100/122 X |
| 2,633,074 | 3/1953 | Davis | 100/122 X |

*Primary Examiner*—Peter Feldman

*Attorney, Agent, or Firm*—Kane, Dalsimer, Kane, Sullivan and Kurucz

[57] ABSTRACT

In a hydro-extractor, a screw is disposed with an outer concentric cylindrical sieve. The sieve is formed of sections placed lengthwise of the screw, with each section capable of having the same or different size holes so that the extractor captures solids both large and small in a controlled manner and will dewater faster or slower with various combinations of sieve sections. To increase solids capture in desired portions of the extractor, the sieve is formed with a cloth or other fibrous material disposed between two supporting members.

8 Claims, 5 Drawing Figures

SCREEN FOR HYDRO-EXTRACTOR

CROSS REFERENCE TO RELATED PATENTS AND APPLICATIONS

The hydro-extractor of the present invention is an improvement over the apparatus of U.S. Pat. No. 3,394,649 and commonly assigned pending application Ser. No. 754,162, filed Dec. 27, 1976 which is a continuation-in-part of application Ser. No. 647,973 filed Jan. 9, 1976, now abandoned.

BACKGROUND OF THE INVENTION

This invention relates generally to devices for extracting water and other liquids from liquid impregnated materials, such as waste, pulp, raw sewerage and waste water in general, and more particularly, to such a unit in the form of a helical screw undergoing relative rotation with respect to a surrounding drainage screen.

The device which is the subject of this invention finds particular use with a waste disposal apparatus or system wherein upon treatment of the waste material, means must be provided for separating the solids and the liquids from within a slurry. This waste disposal system in general, may or may not include a pulper having a tank containing the waste material, fibrous material, garbage and other disposable waste in the presence of a high percentage of water, all being subjected to the disintegrating action of a rotatable impeller having suitable material disintegrating cutters. (See commonly assigned U.S. Pat. Nos. 2,729,146; 3,164,329; 3,584,800; 3,620,460 and 3,885,745.) In apparatus of this type there is associated with the tank discharge, a means for delivering the water-laden material to a liquid extracting device often referred to as a hydro-extractor in which a helical screw is made to undergo rotation within a cylindrical sieve. The hydro-extractor separates the solids from the liquids by withdrawing the liquid from the material received from the pulper or selected disintegrating or mascerating unit. In U.S. Pat. No. 3,394,649, having a common assignee with this application, there is disclosed such a hydro-extractor in which there is a cylindrical screen or hollow cylindrical sieve surrounding the major portion of the screw.

SUMMARY OF THE INVENTION

It is an object of the invention to provide a hydro-extractor of the type described above in which at least one section of the sieve is formed by two supporting portions with a fibrous or other porous material interposed between.

It is another object of the invention to optimize hole density in at least one portion of the sieve.

It is another object of the invention to provide a sieve which will increase the solids captured in the apparatus without the necessity of punching holes in thin gauge metal.

It is a further object to provide apparatus of the foregoing type which is economically manufactured, is efficient, well suited for its intended purpose and capable of sieve section modulation to alter the operating parameters in response to the waste material being handled.

BRIEF DESCRIPTION OF THE DRAWINGS

Other objects and advantages will become apparent from the following description which is to be taken in conjunction with the accompanying drawings, in which.

DETAILED DESCRIPTION OF THE PREFERRED EMBODIMENT

Figure 1:
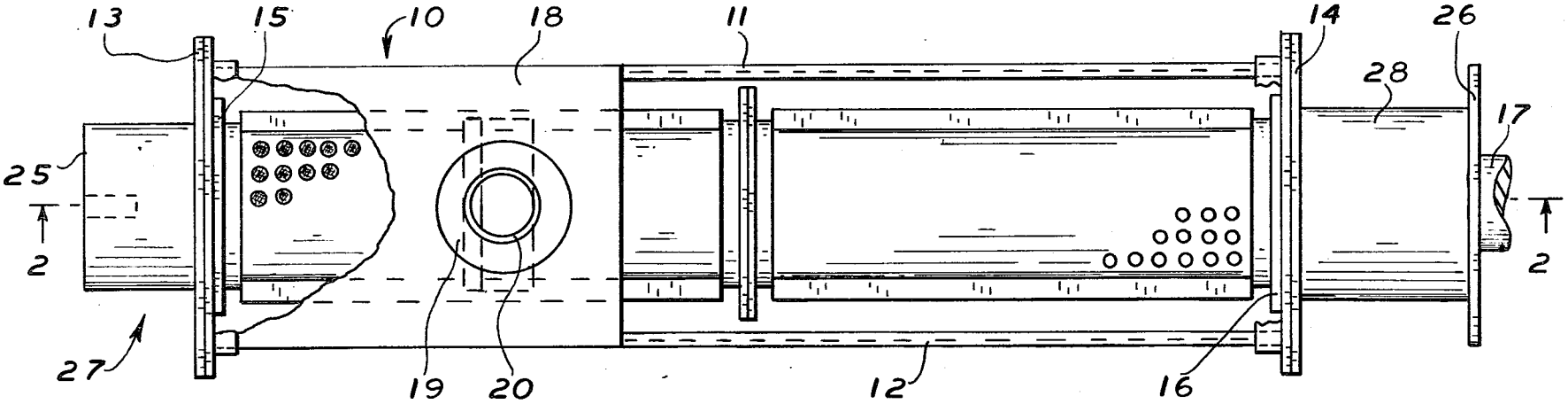
FIG. 1 is an elevational view of a liquid extracting device embodying the present invention with portions thereof cut away or removed to disclose certain details of construction.
Figure 5:
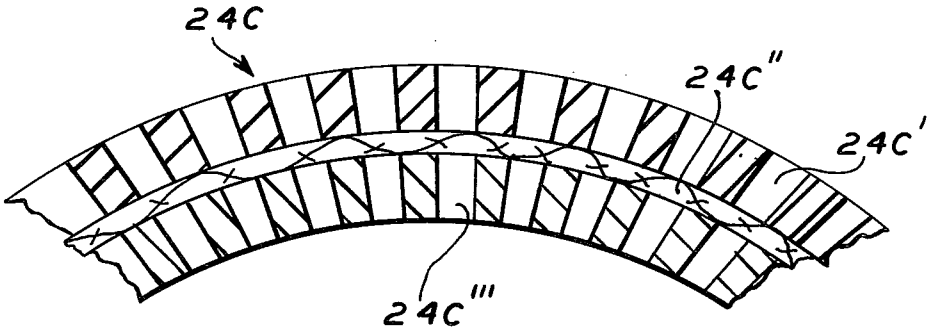
FIG. 5 is an enlarged sectional view showing a part of a supported sieve section.

Referring now to the drawings, there is shown a liquid extracting device 10 having a shell consisting of vertically extending members 11 and 12 and end members 13 and 14 at either end. Affixed to the end members 13 and 14 are brackets or baffles 15 and 16 having openings through which a screw shaft 17 passes. A plate 18 provided with a baffle 19 with an opening through which passes a tube 20, and a plate 21 serve to complete the shell for the device.

The screw 22 of the hydro-extractor consists of a cylindrical screw shaft 17 having flights 23 providing an inclined surface in the form of a helix or screw surrounding and attached to the shaft. A cylindrical screen or hollow cylindrical sieve 24 surrounds the major portion of screw 22 in the zone between the baffles 15 and 16. One end of shaft 17 is supported in end bearing 25 and the other end of the shaft is supported in end bearing support 26. The end bearing support 25 is part of a cap 27 affixed to the end member 13. The end bearing support 26 is spaced from the end member 14 and has cover plates 28 on the top and two sides to provide a pulp discharge chamber or zone 29. The material from which water has been extracted is fed by the screw into this chamber and then out of the open bottom of the chamber. Means not shown are provided for rotating the screw 22 at the proper speed, and a means for introducing a mixture of solids and liquids into the apparatus is shown at 32.

Figure 2:
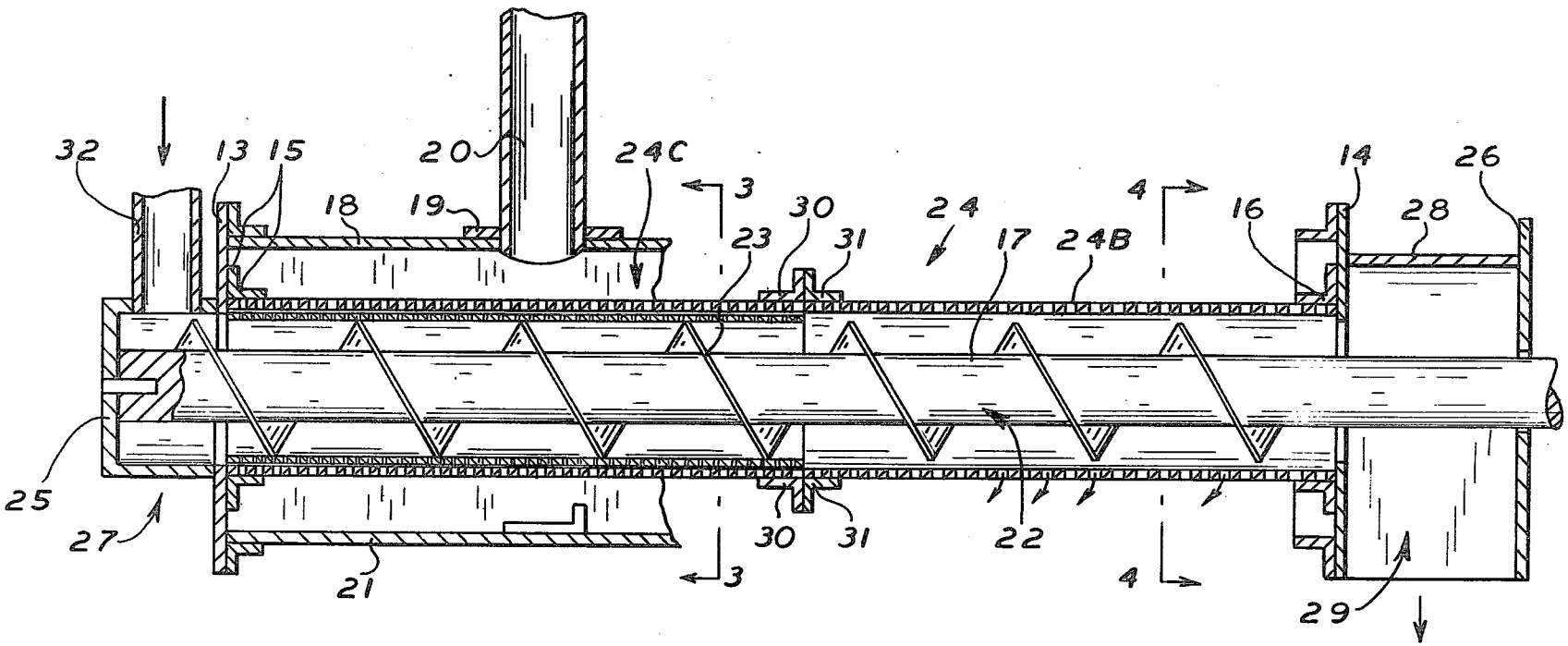
FIG. 2 is a sectional view taken along the line 2—2 of FIG. 1.
Figure 3:
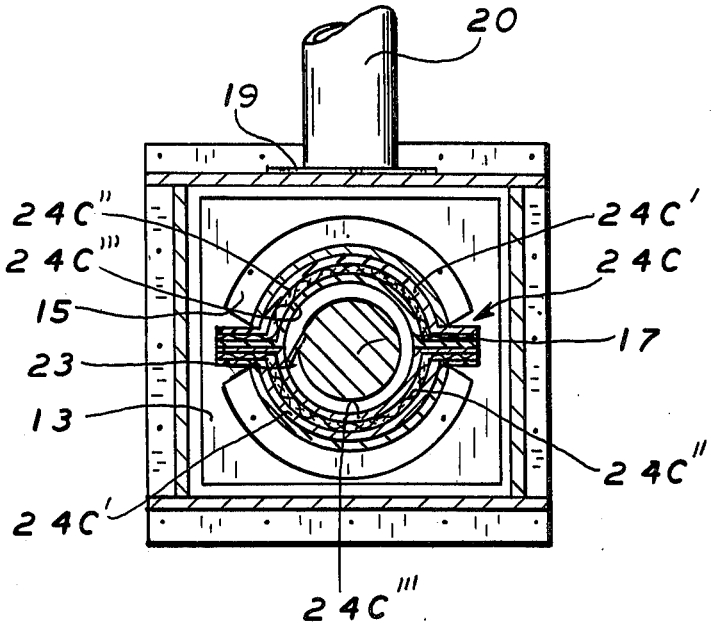
FIG. 3 is a sectional view taken along the line 3—3 of FIG. 2.
Figure 4:
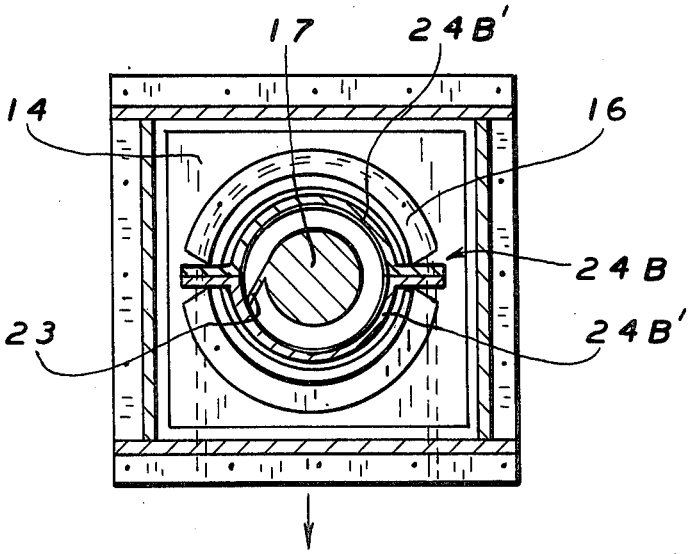
FIG. 4 is a sectional view taken along the line 4—4 of FIG. 2.

Referring to FIGS. 2, 3 and 4, it will be seen that the cylindrical screen 24 is made up of a plurality of sections bolted together at their ends to form the long screen 24. FIG. 2 shows two sections 24C and 24B having the same or different solids capture and water extraction characteristics held together at their ends by brackets or baffles 30 and 31. Such brackets or baffles 30 and 31 are similar to the brackets or baffles 15 and 16 at the opposite ends of such sections 24C and 24B. If necessary three or more sections can be secured together in the same manner to form the cylindrical screen 24 with each section having different or similar solids capture and water extraction characteristics.

In particular application of the present invention, it was preferred that section 24C have relatively high solids capture characteristics. Towards this end, a thin membrane or cloth 24C″ is interposed between supporting members 24C′ and 24C‴. Membrane 24C″ may be made from woven or unwoven fibrous material or be of suitable resinous or metallic material that would require support to withstand the pressures during extraction. The holes in support members 24C′ and 24C‴ allow the passage of water, the supporting portions themselves are of sufficient thickness to withstand the pressures encountered in dewatering.

In the stated application section 24B in designed to effectively dewater the solids captured by section 24C. Therefore, the hole size is larger; and in this connection it has been found that with hole sizes and sheet gauges of 0.062" and larger, no back-up or support is required. FIG. 4 shows the section 24B made up of two screens 24B' which are formed into two half cylinders secured together along their lengthwise edges.

Alternatively, section 24B may be constructed in a manner similar to 24C. The membrane between the supporting members may be of greater porosity than membrane 24C" to facilitate the extraction process. This embodiment is not shown in the drawings.

Since the operation of the hydro-extractors is well known (see for example U.S. Pat. No. 3,394,649) it is not necessary to describe such operation. It will be apparent that the ability to select and combine screen sections with different size holes provides an opportunity for capture and drainage of waste material not found in the hydro-extractors of the prior art. It will also be apparent that a membrane of the type described above effectively increases the amount of solids captured by the apparatus, and may be simply constructed and incorporated within.

Although somewhat preferred embodiments of the invention have been disclosed and described herein, it should be understood that different hole sizes may be utilized within the apparatus, and that a plurality of membranes may be positioned between the supports in any section of the hydro-extractor. In addition, membranes of different permeabilities may be utilized in certain sections of the cylindrical sieve to allow varying rates of extraction. The invention is in no sense limited by the above descriptions, and its scope is to be determined by that of the appended claims.

What is claimed is:

1. In a hydro-extractor of the type designed to receive a mixture of liquid and solids and to form a plug of material therefrom having in combination a shaft, a helical screw formed on a portion of said shaft, means for introducing said mixture onto said screw, a cylindrical sieve surrounding said screw and concentric with said shaft, and means for rotating said screw within said sieve and emitting liquid from said mixture through said sieve to form and move said plug axially towards a discharge space, the improvement comprising:

said sieve comprising a plurality of cylindrical sieve sections secured together at their ends;

a first sieve section nearest said means for introducing said mixture onto said screw including a porous membrane and supporting means for supporting both sides of said porous membrane, said first sieve section adapted to permit relatively high solids capture;

a second sieve section nearer said discharge space than said first sieve section, said second sieve section having greater permeability than said first sieve section to facilitate dewatering of captured solids.

2. The invention in accordance with claim 1 in which said second sieve section includes a permeable screen requiring no support means.

3. The invention in accordance with claim 1 in which each section comprises a pair of half cylinders secured along their lengthwise edges.

4. The invention in accordance with claim 1, in which said membrane is cloth.

5. The invention in accordance with claim 1, in which said membrane is made from unwoven fibrous material.

6. The invention in accordance with claim 1, in which said membrane is made from woven fibrous material.

7. The invention in accordance with claim 1, in which said membrane is of resinous material.

8. The invention in accordance with claim 1, in which said membrane is of metallic material.

* * * * *